US007775624B2

(12) United States Patent
Kusakari

(10) Patent No.: US 7,775,624 B2
(45) Date of Patent: Aug. 17, 2010

(54) EJECTION RESTORATION APPARATUS FOR LIQUID EJECTION HEAD AND IMAGE FORMING APPARATUS COMPRISING EJECTION RESTORATION APPARATUS

(75) Inventor: Tsutomu Kusakari, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 785 days.

(21) Appl. No.: 11/723,697

(22) Filed: Mar. 21, 2007

(65) Prior Publication Data

US 2007/0222815 A1 Sep. 27, 2007

(30) Foreign Application Priority Data

Mar. 22, 2006 (JP) ..... 2006-079416

(51) Int. Cl.
*B41J 29/393* (2006.01)

(52) U.S. Cl. ..... 347/29; 347/19; 347/30; 347/33

(58) Field of Classification Search ..... 347/14, 347/19, 22, 23, 29, 30–34
See application file for complete search history.

(56) References Cited

U.S. PATENT DOCUMENTS 5,055,861 A 10/1991 Murayama et al.
7,364,254 B2 * 4/2008 Yamazaki et al. ..... 347/23

FOREIGN PATENT DOCUMENTS

JP 2-179756 A 7/1990
JP 6-328729 A 11/1994

* cited by examiner

*Primary Examiner*—Juanita D Stephens
(74) *Attorney, Agent, or Firm*—Birch, Stewart, Kolasch & Birch, LLP

(57) ABSTRACT

The ejection restoration apparatus for a liquid ejection head having a plurality of nozzles which are disposed in a planar nozzle surface and from which liquid is ejected, includes: a first suction cap which covers a partial region of the planar nozzle surface and which has a contact portion being constituted by an elastic body and making contact with the planar nozzle surface, the partial region being smaller than area of the planar nozzle surface in which the nozzles are disposed and being larger than cross-sectional area of one of the nozzles; a suction cap movement device which moves the first suction cap in parallel with the planar nozzle surface while causing the contact portion of the first suction cap to make contact with the planar nozzle surface; a nozzle abnormality detection device which detects an abnormal nozzle suffering an abnormality, in the nozzles; and a suction control device which causes the first suction cap to suction the liquid in the abnormal nozzle detected by the nozzle abnormality detection device, wherein the first suction cap is moved on the planar nozzle surface in a state where a space defined by the first suction cap and the planar nozzle surface is set to a pressure lower than an atmospheric pressure, so that the first suction cap fulfills both a wiping function and a suctioning function.

6 Claims, 10 Drawing Sheets

EJECTION RESTORATION APPARATUS FOR LIQUID EJECTION HEAD AND IMAGE FORMING APPARATUS COMPRISING EJECTION RESTORATION APPARATUS

BACKGROUND OF THE INVENTION

1. Field of the Invention

The present invention relates to a restoration apparatus for a liquid ejection head and an image forming apparatus comprising a restoration apparatus for a liquid ejection head, and more particularly, to an ejection restoration apparatus for nozzles which can be used when a nozzle blockage or the like has occurred in an apparatus which forms an image by ejecting ink onto a recording medium, or the like, and to an image forming apparatus comprising such an ejection restoration apparatus.

2. Description of the Related Art

As an image forming apparatus in the related art, an inkjet printer (inkjet recording apparatus) is known, which comprises an inkjet head (liquid ejection head) having an arrangement of a plurality of liquid ejection nozzles and which records an image on a recording medium by ejecting ink (liquid) from the nozzles toward the recording medium while causing a relative movement between the inkjet head and the recording medium.

The inkjet head of an inkjet printer of this kind has pressure generating units, each comprising, for example, a pressure chamber to which ink is supplied from an ink tank via an ink supply channel, a piezoelectric element which is driven by an electrical signal in accordance with image data, a diaphragm which constitutes a portion of the pressure chamber and deforms in accordance with the driving of the piezoelectric element, and a nozzle which is connected to the pressure chamber and from which the ink inside the pressure chamber is ejected in the form of a droplet because of the volume of the pressure chamber being reduced by the deformation of the diaphragm. In such an inkjet printer, one image is formed on a recording medium by combining dots formed by ink ejected from the nozzles of the pressure generating units.

An inkjet printer of this kind records information by ejecting ink directly from very fine nozzles, and there is a possibility of printing defects caused by ejection defects or ejection failures due to abnormality of the state of the nozzles. Therefore, it is necessary to maintain the ink in a state which allows normal ejection at all times.

In particular, in an on-demand type of inkjet printer which ejects ink only when an image signal is input, there may be nozzles which do not perform ink ejection over a long period of time. In this case, the ink solvent evaporates from the nozzles, the viscosity of the ink increases or the ink dries, and ejection defects may occur. Phenomena of this kind may also occur if a recording operation is not carried out for a long period of time.

In order to prevent ejection defects of this kind, almost all inkjet printers include restoration mechanisms or restoration apparatuses of various types, which remove ink having increased viscosity inside the nozzles and a dried film (of ink) on the nozzle surface, thereby setting the nozzles to a state capable of normal ejection. Moreover, in addition to removing the ink having increased viscosity and the dried film, nearly all restoration mechanisms or restoration apparatuses also have a function for removing foreign matters, such as dust inside the nozzles, and ink, dirt, or the like, adhering to the nozzle surface. More specifically, the following inventions are disclosed as technologies of this kind.

Japanese Patent Application Publication No. 2-179756 discloses a constituent part which includes an ink absorbing device and a wiping device having a blade, and this constituent part can simplify maintenance operations.

Japanese Patent Application Publication No. 6-328729 discloses an ejection restoration apparatus for an inkjet head having a partial suctioning device which suctions ink while abutting against the nozzle surface and performing a wiping movement.

However, in the related art, during the maintenance of the inkjet head, it is necessary to carry out a wiping operation and a suctioning operation by capping, successively, and there is a possibility that the composition becomes complex. Moreover, since a large amount of maintenance time is required in order to carry out these operations, then throughput may decline. Furthermore, if ink is suctioned from the whole of the inkjet head, then there is a large amount of wasted ink.

In the invention described in Japanese Patent Application Publication No. 2-179756, although it is possible to simplify the constituent component, capping and suctioning operations and wiping operations must be carried out individually, and therefore a long time is required for maintenance.

Moreover, in the invention described in Japanese Patent Application Publication No. 6-328729, suctioning by capping is not sufficient. More specifically, if the cap is moved while the suctioning is performed, then the received force differs between the front side and the rear side of the cap in terms of the movement direction of the cap. Since no consideration at all is given to this point in Japanese Patent Application Publication No. 6-328729, then air leakage occurs during the suctioning by means of the cap and it is difficult to carry out sufficient suctioning. Moreover, since no consideration is given to carrying out wiping by a blade moving over the nozzle surface, then the rigidity of the elastic body may be too high and satisfactory wiping may not be achieved by means of the blade, and ink may therefore be left on the nozzle surface.

In cases where the suctioned portion is smaller than the nozzle plate in which the nozzles are arranged, when only a portion of the nozzles are suctioned (suctioning is carried out in one localized area by applying a negative pressure), then the negative pressure is liable to effect on nozzles other than the nozzles being suctioned. Consequently, in other non-suctioned nozzles, the meniscus (an air-liquid interface inside a nozzle created by the surface tension of the liquid) may be withdrawn, and air or gas bubbles may be caused to flow back into pressure chambers.

SUMMARY OF THE INVENTION

The present invention has been contrived in view of the foregoing circumstances, an object thereof being to provide an ejection restoration apparatus for a liquid ejection head which has both a mechanism for restoring liquid ejection from a nozzle by suctioning and a mechanism for wiping the nozzle surface, whereby liquid in a nozzle suffering an abnormality is suctioned so that the time and ink consumption required for maintenance is reduced, and whereby maintenance by wiping and suctioning with respect to nozzles in the liquid ejection head can be carried out so as to prevent causing adverse effects on other nozzles which are not being suctioned.

In order to attain the aforementioned object, the present invention is directed to an ejection restoration apparatus for a liquid ejection head having a plurality of nozzles which are disposed in planar nozzle surface and from which liquid is ejected, the ejection restoration apparatus comprising: a first suction cap which covers a partial region of the planar nozzle surface and which has a contact portion being constituted by an elastic body and making contact with the planar nozzle surface, the partial region being smaller than area of the planar nozzle surface in which the nozzles are disposed and being larger than cross-sectional area of one of the nozzles; a suction cap movement device which moves the first suction cap in parallel with the planar nozzle surface while causing the contact portion of the first suction cap to make contact with the planar nozzle surface; a nozzle abnormality detection device which detects an abnormal nozzle suffering an abnormality, in the nozzles; and a suction control device which causes the first suction cap to suction the liquid in the abnormal nozzle detected by the nozzle abnormality detection device, wherein the first suction cap is moved on the planar nozzle surface in a state where a space defined by the first suction cap and the planar nozzle surface is set to a pressure lower than an atmospheric pressure, so that the first suction cap fulfills both a wiping function and a suctioning function.

Preferably, the contact portion includes a front portion situated on a front side and a rear portion situated on a rear side in terms of a movement direction of the first suction cap; and the rear portion has a rigidity lower than the front portion.

Preferably, the ejection restoration apparatus for a liquid ejection head further comprises a second suction cap which is provided on an outer side of the first suction cap so as to cover a whole of the first suction cap, wherein a following inequality is satisfied: $P1<P2<P0$, where P1 is a pressure of the space defined by the first suction cap and the planar nozzle surface, P2 is a pressure of a space defined by the second suction cap and the planar nozzle surface, and P0 is the atmospheric pressure.

Preferably, the ejection restoration apparatus for a liquid ejection head further comprises a second suction cap provided on a front side of the first suction cap in terms of a movement direction of the first suction cap, wherein a following inequality is satisfied: $P1<P2<P0$, where P1 is a pressure of the space defined by the first suction cap and the planar nozzle surface, P2 is a pressure of a space defined by the second suction cap and the planar nozzle surface, and P0 is the atmospheric pressure.

Preferably, the suction cap movement device moves the first suction cap in such a manner that, in maintenance of the liquid ejection head, a movement direction of the first suction cap corresponds to a direction of flow of the liquid in a common flow channel which is supplied to the common flow channel via a liquid supply port, the common flow channel being provided on a side of the nozzles reverse to a liquid ejection side of the nozzles and supplying the nozzles with the liquid.

In order to attain the aforementioned object, the present invention is also directed to an image forming apparatus comprising any one of the above-described ejection restoration apparatuses for a liquid ejection head.

As described above, according to the present invention, a mechanism which restores liquid ejection at nozzles by means of suctioning is combined with a mechanism which wipes the nozzle surface, and the ink consumption and time required for maintenance can be reduced by suctioning (only) a nozzle which is suffering an abnormality. Moreover, it is possible to carry out maintenance by suctioning and wiping the nozzles of the liquid ejection head, without causing adverse effects on other nozzles which are not suctioned.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
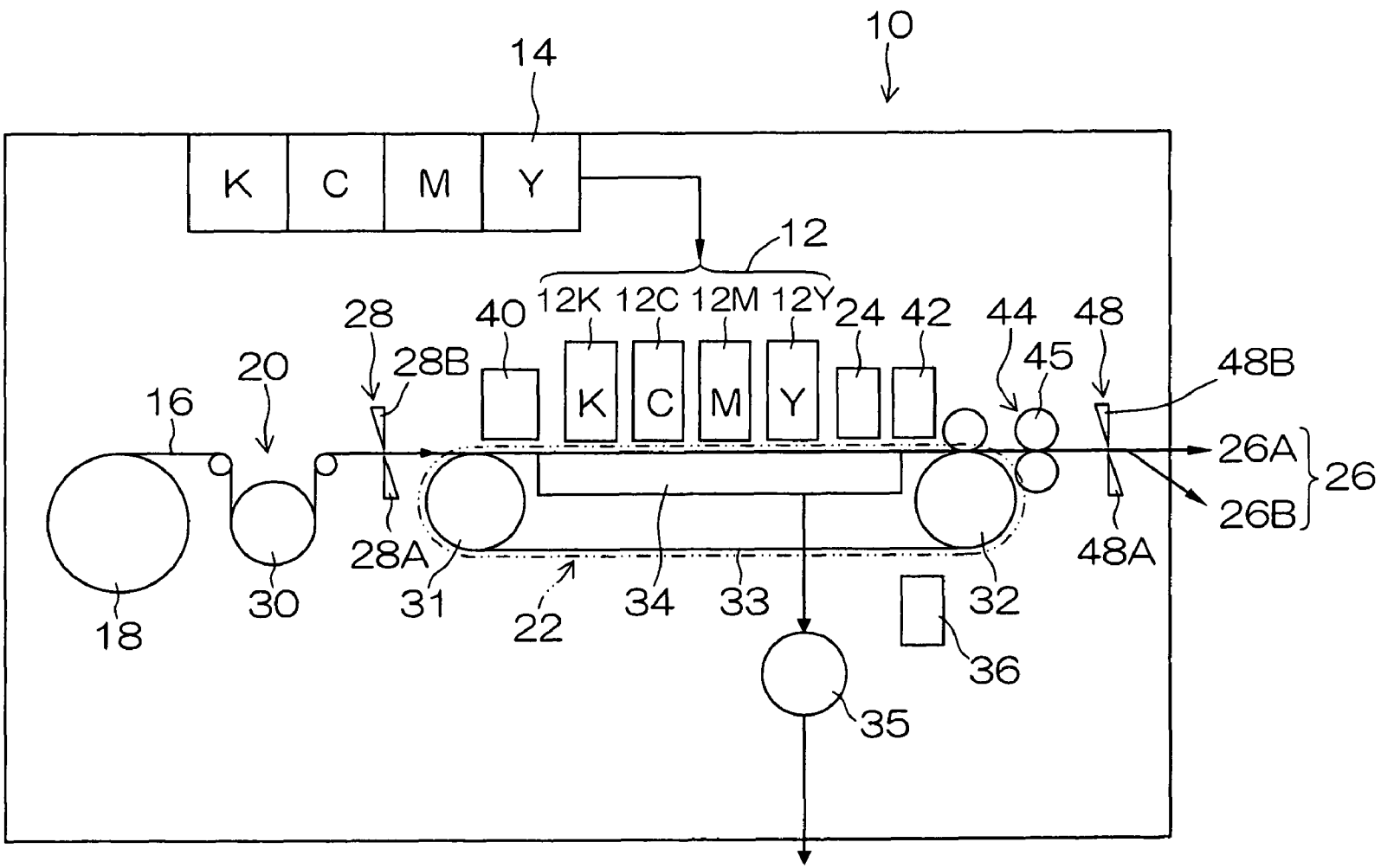
FIG. 1 is a general schematic drawing of an image forming apparatus according to an embodiment of the present invention.

FIG. 1 is a general schematic drawing showing an inkjet recording apparatus forming an image forming apparatus according to an embodiment of the present invention. As shown in FIG. 1, the inkjet recording apparatus 10 comprises: a printing unit 12 having a plurality of liquid ejection heads (simply called "head" in places hereinafter) 12K, 12C, 12M, and 12Y, provided for ink colors of black (K), cyan (C), magenta (M), and yellow (Y), respectively; an ink storing and loading unit 14 for storing inks of K, C, M, and Y to be supplied to the print heads 12K, 12C, 12M, and 12Y; a paper supply unit 18 for supplying recording paper 16; a decurling unit 20 for removing curl in the recording paper; a suction belt conveyance unit 22 disposed facing the nozzle faces (ink ejection faces) of the heads 12K, 12C, 12M, and 12Y, for conveying the recording paper 16 (recording medium) while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which rolled paper is used, a cutter (a first cutter) 28 is provided as shown in FIG. 1, and the rolled paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the heads12K, 12C, 12M, and 12Y and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction. The belt 33 is driven in the clockwise direction in FIG. 1 by the motive force of a motor 88 (not shown in FIG. 1, but shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration of nipping such as a brush roller and a water absorbent roller, an air blow configuration in which clean air is blown, or a combination of these. In the case of the configuration of nipping the cleaning rollers, it is preferable to make the line velocity of the cleaning rollers different than that of the belt 33 to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
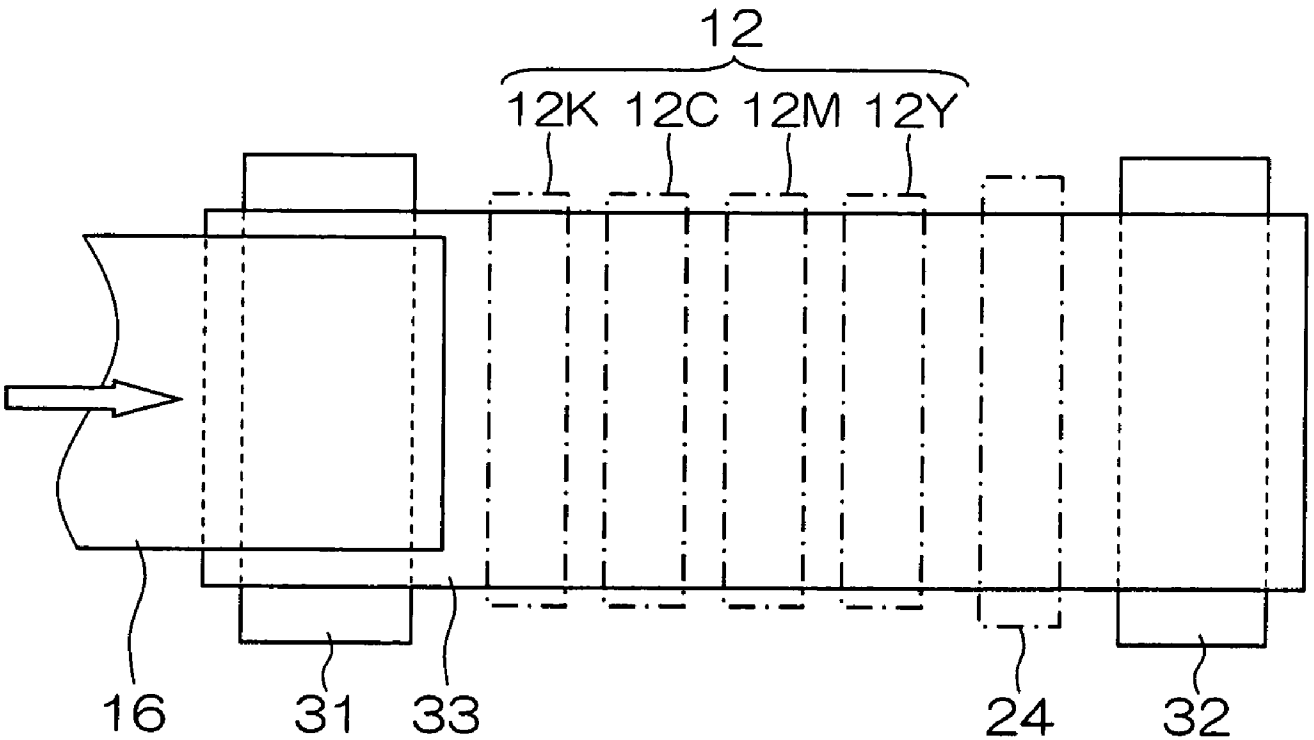
FIG. 2 is a principal plan diagram of the peripheral area of a print unit in the image forming apparatus shown in FIG. 1.

FIG. 2 is a principal plan diagram showing the periphery of the print unit 12 in the inkjet recording apparatus 10.

As shown in FIG. 2, the print unit 12 has so-called "full line heads" in which a line head having a length corresponding to the maximum paper width is arranged in a direction (main scanning direction) that is perpendicular to the paper feed direction (sub-scanning direction). The heads 12K, 12C, 12M, and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The heads 12K, 12C, 12M, and 12Y are arranged in the order of black (K), cyan (C), magenta (M), and yellow (Y) from the upstream side (on the left hand side in FIG. 1), along the conveyance direction of the recording paper 16. A color image can be formed on the recording paper 16 by ejecting the inks from the heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper feed direction just once (in other words, by means of a single sub-scan). Higher-speed printing is thereby made possible and productivity can be improved in comparison with a shuttle type head configuration in which a head moves reciprocally in the main scanning direction perpendicular to the paper conveyance direction.

Although a configuration with four standard colors, K, M, C, and Y, is described in the present embodiment, the combinations of the ink colors and the number of colors are not limited to these, and light and/or dark inks can be added as required. For example, a configuration is possible in which heads for ejecting light-colored inks such as light cyan and light magenta are added.

As shown in FIG. 1, the ink storing and loading unit 14 has ink tanks for storing the inks of the colors corresponding to the respective heads 12K, 12C, 12M, and 12Y, and the respective tanks are connected to the heads 12K, 12C, 12M, and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure can prevent the ink from coming into contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

Structure of the Ink Ejection Head

Next, the structure of a head is described below. The heads 12K, 12C, 12M, and 12Y of the respective ink colors have the same structure, and a reference numeral 50 is hereinafter designated to any of the heads.

Figure 3A:
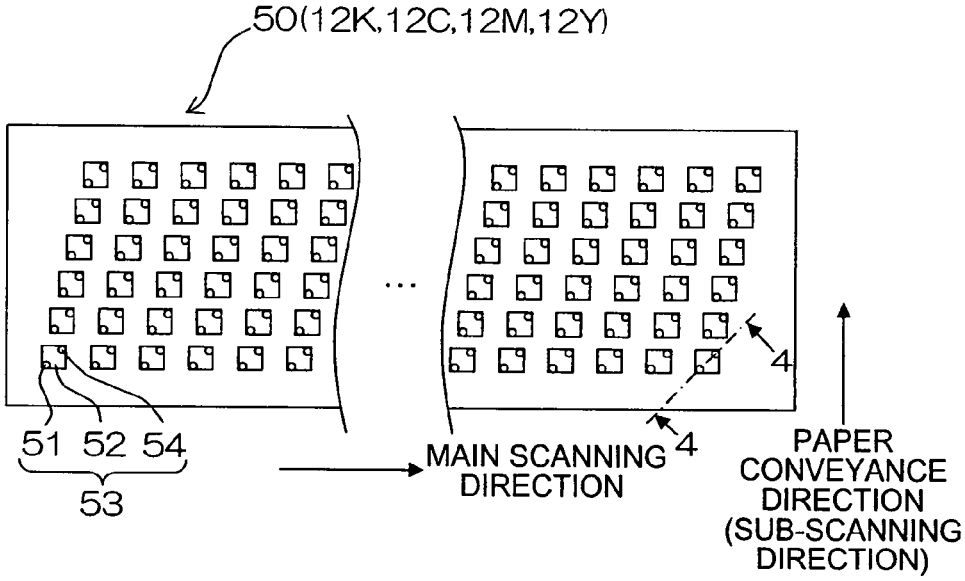
FIGS. 3A to 3C are plan view perspective diagrams showing embodiments of the composition of a liquid ejection head.
Figure 3B:
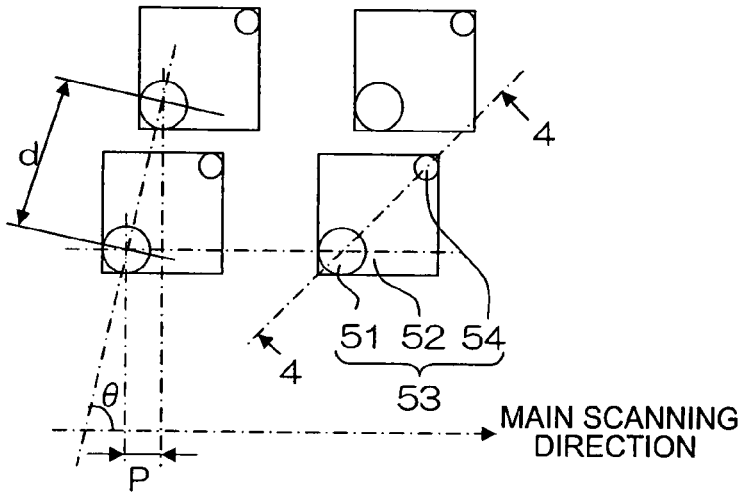
Figure 3C:
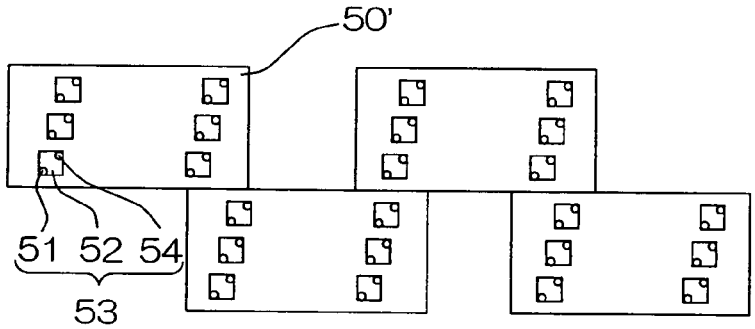

FIG. 3A is a perspective plan view showing an embodiment of the configuration of the head 50, FIG. 3B is an enlarged view of a portion thereof, and FIG. 3C is a perspective plan view showing another embodiment of the configuration of the head 50.

The nozzle pitch in the head 50 should be minimized in order to maximize the density of the dots printed on the surface of the recording paper 16. As shown in FIGS. 3A to 3C, the head 50 according to the present embodiment has a structure in which a plurality of ink chamber units 53, each comprising a nozzle 51 forming an ink droplet ejection port, a pressure chamber (liquid chamber) 52 corresponding to the nozzle 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

The mode of forming one or more nozzle rows through a length corresponding to the entire width of the recording paper 16 in the main scanning direction substantially perpendicular to the paper conveyance direction of the recording paper 16 is not limited to the embodiment described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

The present embodiment describes a mode in which the planar shape of the pressure chambers 52 is substantially a square shape, but the planar shape of the pressure chambers 52 is not limited to being a substantially square shape, and it is possible to adopt various other shapes, such as a substantially circular shape, a substantially elliptical shape, a substantially parallelogram (diamond) shape, or the like. Furthermore, the arrangement of the nozzles 51 and the supply ports 54 is not limited to the arrangement shown in FIGS. 3A to 3C, and it is also possible to arrange nozzles 51 substantially in the central region of the pressure chambers 52, or to arrange the supply ports 54 in the side walls of the pressure chambers 52.

As shown in FIG. 3B, the high-density nozzle head according to the present embodiment is achieved by arranging a plurality of ink chamber units in a lattice fashion based on a fixed arrangement pattern, in a row direction which coincides with the main scanning direction, and a column direction which is inclined at a fixed angle of $\theta$ with respect to the main scanning direction, rather than being perpendicular to the main scanning direction.

More specifically, by adopting a structure in which a plurality of ink chamber units 53 are arranged at a uniform pitch d in line with a direction forming an angle of $\theta$ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction, a structure having nozzle rows arranged in a two-row staggered configuration, and the like.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording medium (main-scanning direction) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIGS. 3A to 3C are driven, the main scanning according to the above-described (3) is preferred.

On the other hand, "sub-scanning" is defined as to repeatedly perform printing of one line (a line formed of a row of dots, or a line formed of a plurality of rows of dots) formed by the main scanning, while moving the full-line head and the recording paper 16 relatively to each other.

In the present embodiment, a full line head is described, but the scope of application of the present invention is not limited to this and it can also be applied to a serial type of head which carries out printing in the breadthways direction of the recording paper 16 while scanning a short head having nozzle rows of a length shorter than the width of the recording paper 16, in the breadthways direction of the recording paper 16.

As shown in FIGS. 3A to 3C, the pressure chamber 52 provided corresponding to each of the nozzles 51 is approximately square-shaped in plan view, and a nozzle 51 formed in the nozzle substrate 59, and a supply port 54, are provided respectively at either corner of a diagonal of the pressure chamber 52. The pressure chambers 52 are connected to a common flow channel (common liquid chamber), which is not illustrated, via the supply ports 54 shown in FIGS. 3A and 3B. The common flow channel is connected to an ink supply tank which is not shown in the drawings, and the ink supplied from the ink supply tank is distributed and supplied to the pressure chambers 52 via the common flow channel.

Structure of Liquid Ejection Head

Next, the detailed structure of the liquid ejection head is described below with reference to FIG. 4.

Figure 4:
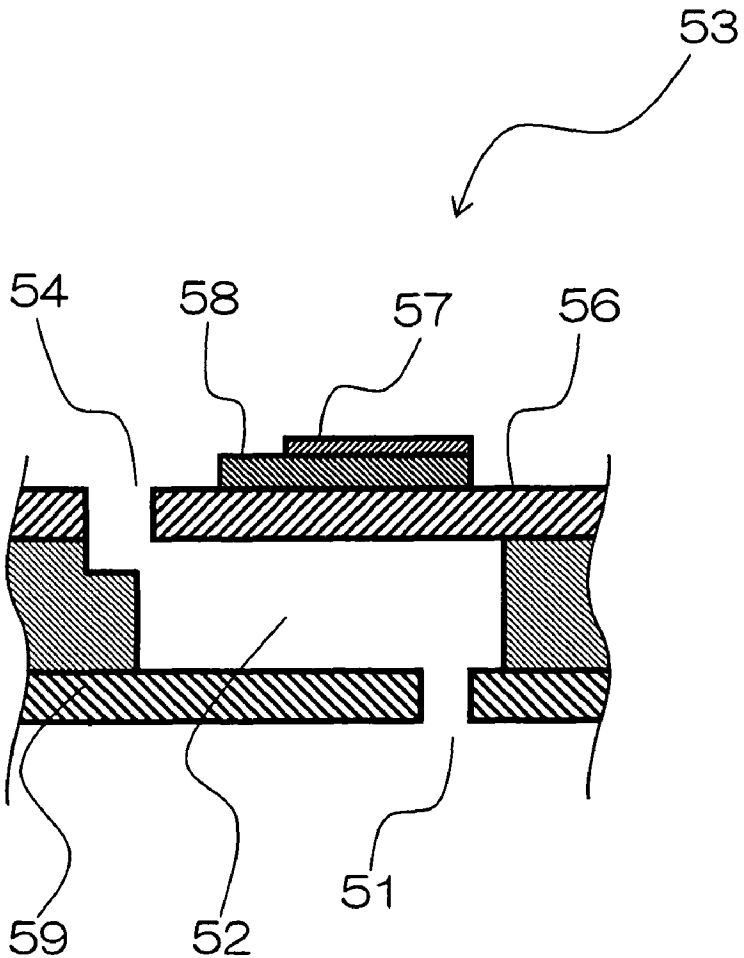
FIG. 4 is a cross-sectional diagram showing the composition of a liquid ejection head.

FIG. 4 is a cross-sectional diagram showing the composition of an ink chamber unit 53 which corresponds to one nozzle (a cross-sectional diagram along line 4-4 in FIGS. 3A and 3B).

As shown in FIG. 4, the pressure chamber unit 53 includes a pressure chamber 52 connected to a nozzle 51 from which ink is ejected, and the pressure chamber unit 53 is connected to a common liquid chamber (not illustrated) which supplies ink to the pressure chamber unit 53 via a supply port 54. Furthermore, one surface (in the diagram, the ceiling) of the pressure chamber 52 is constituted by a diaphragm 56, and a piezoelectric element 58 which causes the diaphragm 56 to deform is bonded on the diaphragm 56, and an individual electrode 57 is formed on the upper surface of the piezoelectric element 58. The diaphragm 56 also serves as a common electrode, and the nozzle 51 is formed by a hole provided in the nozzle plate 59.

The piezoelectric element 58 is interposed between the common electrode (diaphragm 56) and the individual electrode 57, and it deforms when a drive voltage is applied between the common electrode (diaphragm 56) and the individual electrode 57. A structure is adopted in which the diaphragm 56 deforms in accordance with the deformation of the piezoelectric element 58, thereby reducing the volume of the pressure chamber 52 and applying pressure to the ink inside the pressure chamber 52, and accordingly, the ink is ejected from the nozzle 51. When the voltage applied between the common electrode (diaphragm 56) and the individual electrode 57 is released, the piezoelectric element 58 returns to its original position, the volume of the pressure chamber 52 returns to its original size, and new ink is supplied into the pressure chamber 52 from the common liquid channel and via the supply port 53.

Ejection Restoration Apparatus

Below, the ejection restoration apparatus for a liquid ejection head according to the present embodiment is described with reference to FIG. 5.

Figure 5:
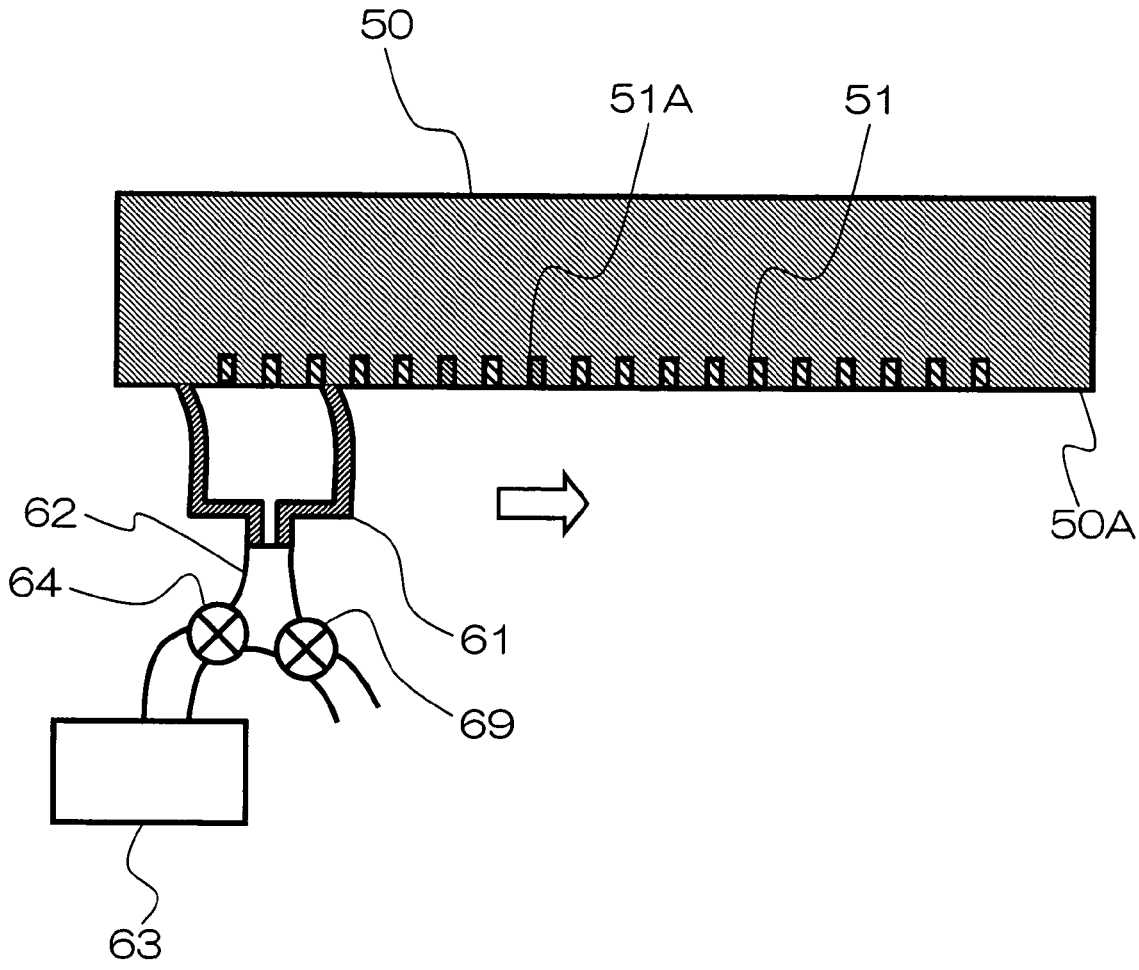
FIG. 5 is a diagram of an ejection restoration apparatus for a liquid ejection head according to a first embodiment of the present invention.

FIG. 5 is a cross-sectional diagram of an ejection restoration apparatus for the liquid ejection head. The ejection restoration apparatus includes a capping member 61, an ink flow channel 62, a suction pump 63, a valve 64 forming a suctioning control device, and a valve 69 capable of controlling opening to the air. When the ink is filled initially into the head, when an ejection problem occurs due to infiltration of an air bubble or foreign matter into the nozzle 51 or the pressure chamber 52, or when an ejection abnormality has occurred or it is predicted that an ejection abnormality will occur because of increased viscosity of the ink or other variations in characteristics, then an ink suctioning operation is carried out.

The capping member 61 makes contact with the nozzle surface 50A of the liquid ejection head 50. The space defined by the capping member 61 and the nozzle surface 50A is sealed (kept airtight), and the interior of this space can be set to a negative pressure by expelling the air of this space by means of the suction pump 63. By setting the interior of the sealed space covered by the capping member 61 to a negative pressure, it is possible to remove ink having increased viscosity in the nozzles 51 or ink inside the nozzles 51 suffering ejection defects. The removed ink is accumulated in a recovery tank (not illustrated), via an ink flow channel 62, by means of the suction pump 63.

Moreover, the portion of the capping member 61 which makes contact with the nozzle surface 50A of the liquid ejection head 50 is constituted by an elastic body. The capping member 61 suctions ink in nozzles, and in particular, the portion of the capping member 61 which makes contact with the nozzle surface 50A serves as a blade which is capable of wiping the nozzle surface 50A. Thereby, a composition is achieved in which suctioning of the ink in nozzles 51 and wiping of the nozzle surface 50A can be carried out simultaneously, by means of this ejection restoration apparatus alone. Therefore, it is possible to reduce the number of components necessary for ink suctioning and wiping, and it is also possible to reduce the time required for ink suctioning and wiping, and hence the throughput of printing can be improved.

The capping member 61 is able to cover a surface area that is larger than the area (cross sectional area) of one nozzle and smaller than the area (cross sectional area) in which the nozzles 51 are arranged in the nozzle plate 59 (the capping member 61 can cover a partial region of the nozzle plate 59, and the partial region includes at least one nozzle). In order to prevent wastage of ink, preferably, the surface area covered by the capping member 61 is not too large, and in the present embodiment, the capping member 61 can cover a portion of the nozzles 51 arranged on the nozzle surface 50A.

In implementing maintenance, it is possible to suction ink from all of the nozzles 51 by moving the capping member 61 in parallel with the nozzle surface 50A, in the direction of the arrow.

In the present embodiment, suctioning of ink from nozzles 51 is carried out only for nozzles 51A where an abnormality, such as an ejection failure, has occurred. More specifically, at first, the ejection states are determined by means of ejection failure determination sensors (not illustrated) provided inside or outside the liquid ejection head 50, or a test print is created and the print is then monitored. Thereby, nozzles 51A suffering abnormalities, such as ejection failures, are identified. The capping member 61 is then moved over the nozzle surface 50A. In this case, the capping member 61 is moved over the nozzle surface, basically in a state where the pump 63 is activated and the valves 64 and 69 are set in a closed state. However, when the capping member 61 is moved to a position at which the capping member 61 covers a nozzle 51A in which an abnormality has been determined, then the valve 64 provided in the ink flow channel 62 is opened. Thereby, the space defined by the capping member 61 and the nozzle surface is set to a negative pressure, and it is possible to suction the ink inside the nozzle 51A in which an abnormality has been determined. Subsequently, when the capping member 61 is moved to a position at which the capping member 61 covers no nozzle 51A in which an abnormality has been determined, then the valve 64 is closed and the valve 69 is opened. Thereby, the pressure of the space defined by the capping member 61 and the nozzle surface rises and approaches atmospheric pressure, and in this case, the ink inside the nozzles 51 located in the region covered by the capping member 61 are not suctioned. Hence, the ink consumed by suctioning can be restricted to a minimum extent, and economical benefits can be obtained.

In the present embodiment, the expulsion of air from inside the capping member 61 is controlled by means of the valve 64. It is possible to control this valve 64 by means of either mechanical control or electrical control. Moreover, instead of controlling the opening and closing of the valve 64, it is also possible to control the expulsion of air by switching the suction pump 63 on and off, either electrically or mechanically.

Description of Control System

Figure 6:
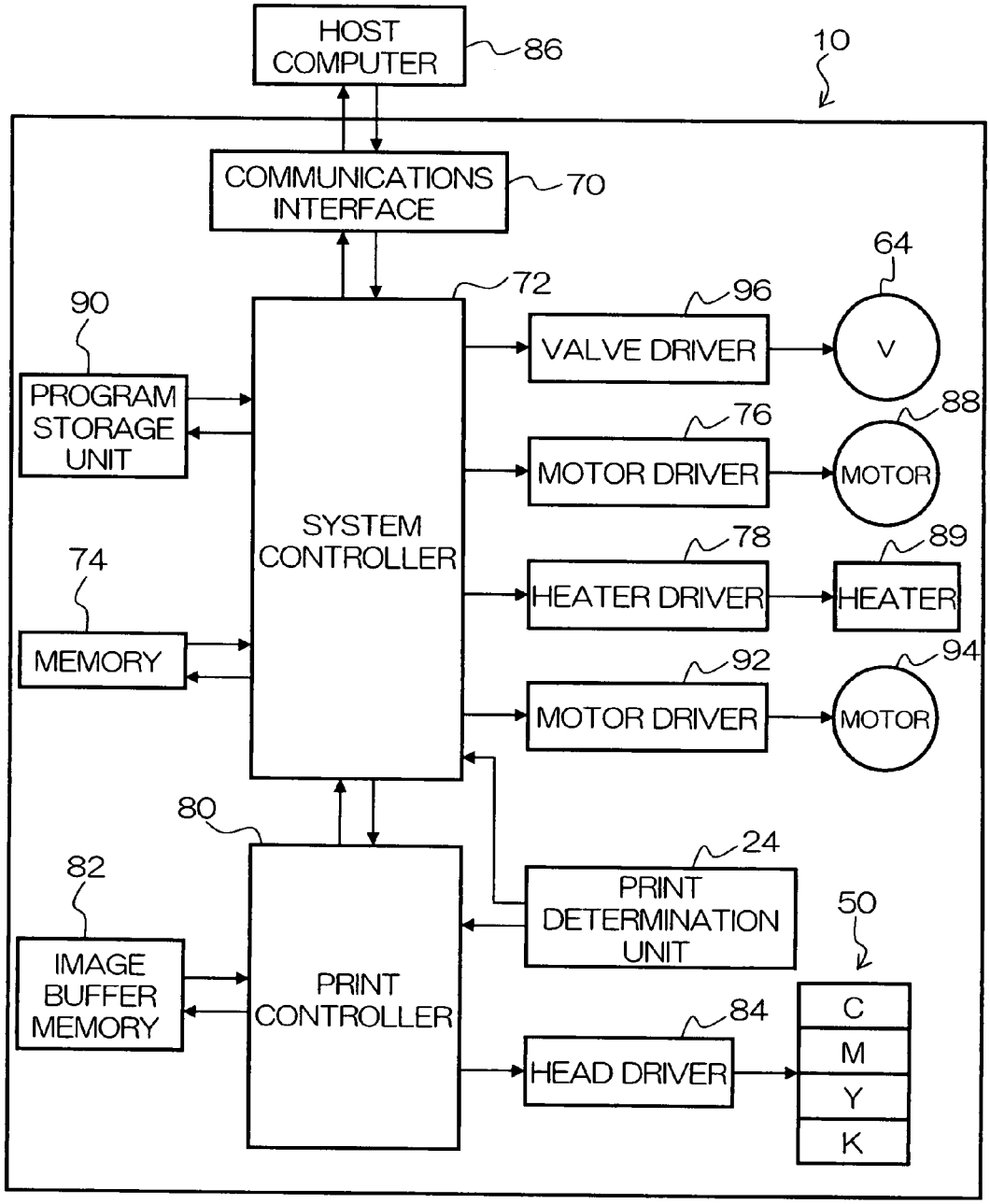
FIG. 6 is a principal block diagram showing the system configuration of an image forming apparatus according to an embodiment of the present invention.

FIG. 6 is a principal block diagram showing a system configuration of the inkjet recording apparatus 10. The inkjet recording apparatus 10 comprises a communications interface 70, a system controller 72, a memory 74, a motor driver 76, a heater driver 78, a print controller 80, an image buffer memory 82, a head driver 84, and the like.

The communications interface 70 is an interface unit for receiving image data sent from a host computer 86. A serial interface such as universal serial bus (USB), IEEE1394, Ethernet™, wireless network, or a parallel interface such as a Centronics interface may be used as the communications interface 70. A buffer memory (not shown) may be mounted in this portion in order to increase the communication speed. The image data sent from the host computer 86 is received by the inkjet recording apparatus 10 through the communications interface 70, and is temporarily stored in the memory 74. The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is a control unit for controlling the various sections, such as the communications interface 70, the memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the memory 74, and the like, it also generates control signals for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 (shown in FIG. 1) and the like in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print control signals to the head driver 84. Required signal processing is carried out in the print controller 80, and the ejection amount and the ejection timing of the ink droplets from the respective print heads 50 are controlled (droplet ejection control) via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 drives the piezoelectric elements 58 of the heads of the respective colors 12K, 12C, 12M, and 12Y on the basis of print data supplied by the print controller 80. The head driver 84 can be provided with a feedback control system for maintaining constant drive conditions for the print heads.

Various control programs are stored in a program storage section 90 and each of the control programs is read out and executed in accordance with commands from the system controller 72. The program storage section 90 may use a semiconductor memory, such as a ROM, EEPROM, or a magnetic disk, or the like. Furthermore, an external interface may be provided, and a memory card or PC card may also be used. Naturally, a plurality of these storage media may also be provided. The program storage section 90 may also be combined with a storage device for storing operational parameters, and the like (not shown).

The print determination unit 24 is a block that includes the line sensor as described above with reference to FIG. 1, reads the image printed on the recording paper 16, determines the print conditions (presence of the ejection, variation in the dot formation, and the like) by performing desired signal processing, and the like, and provides the determination results of the print conditions to the print controller 80. According to requirements, the print controller 80 makes various corrections with respect to the head 50 on the basis of information obtained from the print determination unit 24.

The motor 94 forming a movement device for the suction cap causes the capping member 61 forming the suction cap to perform a sliding movement. The motor driver 92 is a driver (drive circuit) which drives the motor 94 in accordance with instructions from the system controller 72. The valve driver 96 is a driver (drive circuit) which controls the valve 64 (shown in FIG. 5) forming a suction control device, in accordance with instructions from the system controller 72. This valve driver 96 is controlled via the system controller 72 on the basis of print abnormality data obtained by the print determination unit 24.

The system controller 72 and the print controller 80 may be constituted by one processor, and it is also possible to use a device which combines the system controller 72, the motor driver 76, and the heater driver 78, in a single device, or a device which combines the print controller 80 and the head driver in a single device.

Second Embodiment

Next, the ejection restoration apparatus for a liquid ejection head according to a second embodiment of the present invention is described below with reference to FIG. 7. The second embodiment relates to members 61A and 61B of the capping member 61 which are each made of an elastic material, and the members 61A and 61B make contact with the nozzle surface 50A. In the second embodiment, a composition is adopted in which the member 61B on the rear side in terms of the direction of movement of the capping member 61 with respect to the nozzles 51, has a rigidity lower than the rigidity of the member 61A on the front side.

Figure 7:
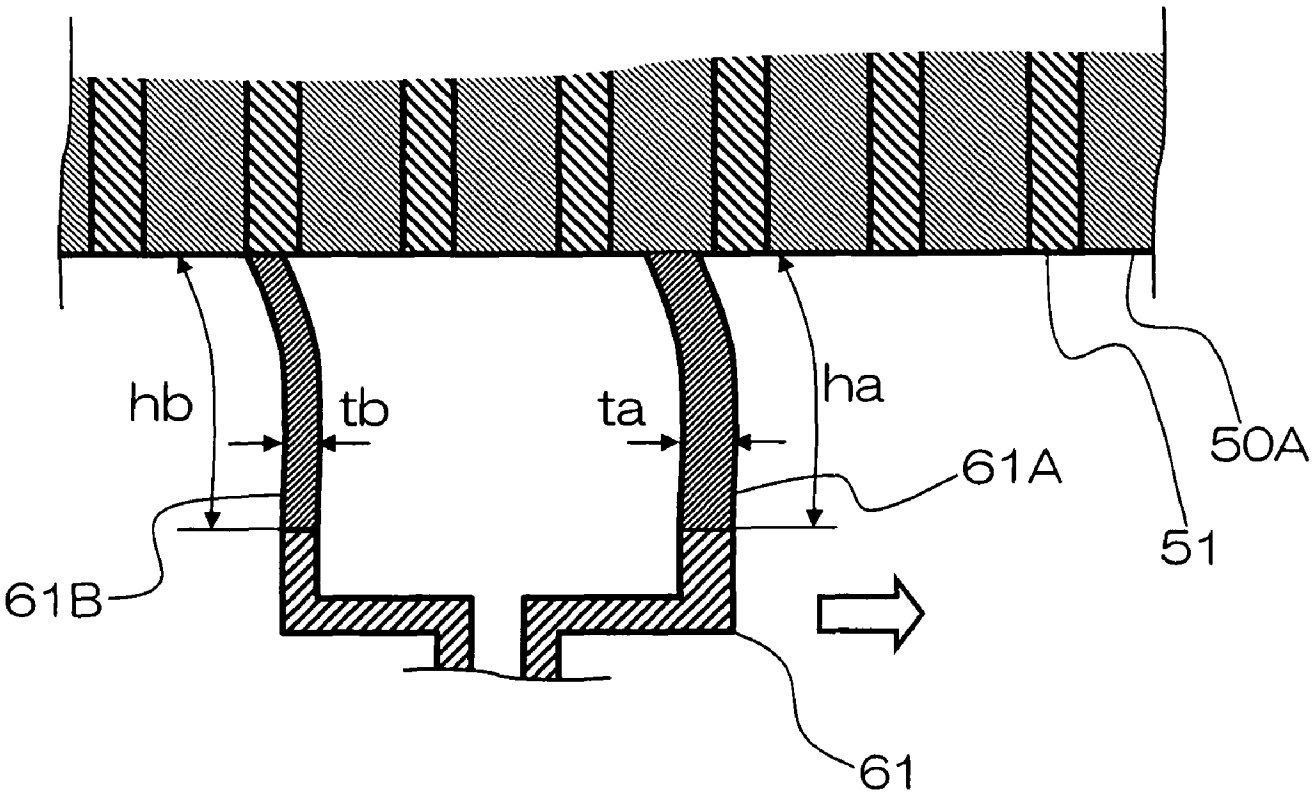
FIG. 7 is a diagram of an ejection restoration apparatus for a liquid ejection head according to a second embodiment of the present invention.

More specifically, when maintenance of the nozzle surface 50A of the liquid ejection head is performed, the capping member 61 is moved along the nozzle surface 50A in the direction of the arrow in FIG. 7. The elastic body forming the front side member 61A, which is situated on a front side in terms of the direction of movement of the capping member 61, is formed to have a thickness (ta) greater than the thickness (tb) of the elastic body forming the rear side member 61B. Thus, the front side member 61A has a relatively high rigidity and the rear side member 61B has a relatively low rigidity (i.e., the front side member 61A has a rigidity greater than the rigidity of the rear side member 61B). Since the front side member 61A has high rigidity, then it is possible to increase the adhesion to the nozzle surface 50A, thereby preventing leaking under the condition of the negative pressure. Moreover, since the rear side member 61B has low rigidity, then it is sufficiently soft and causes less damage to the nozzle surface 50A, compared with the case of a member with high rigidity. Consequently, the ink can be wiped reliably without causing damage to the nozzle surface 50A.

In the present embodiment, in order that the rear side member 61B has a lower rigidity than the front side member 61A of the capping member 61, the elasticity is adjusted by making the thickness (tb) of the rear side member 61B less than the thickness (ta) of the front side member 61A; however, apart from this, it is also possible to adjust the elasticity. The elasticity of the front side member 61A and the rear side member 61B can be adjusted, for example, by making the length (hb) of the rear side member 61B different from the length (ha) of the front side member 61A (e.g., by making the length (hb) of the rear side member 61B greater than the length (ha) of the front side member 61A), by constituting the front side member 61A and the rear side member 61B from different materials, or by changing the amount of material removed from the members. The material of the elastic bodies which constitute the front side member 61A and the rear side member 61B may be rubber, silicon or resin material, for instance.

Third Embodiment

Next, the ejection restoration apparatus for a liquid ejection head according to a third embodiment of the present invention is described below with reference to FIG. 8. In the third embodiment, a second capping member 165 which covers the first capping member 161 is provided.

More specifically, in addition to the first capping member 161 which is capable of performing movement for suctioning and wiping the nozzles 51 of the nozzle surface 50A, a second capping member 165 is further provided so as to cover the first capping member 161 and the whole of the nozzle surface 50A of the liquid ejection head 50. The second capping member 165 is connected to a suction pump 167 via an ink flow channel 166, and the pressure (P2) in the space defined by the second capping member 165 and the nozzle surface 50A of the liquid ejection head 50 is set to a negative pressure compared to the atmospheric pressure (P0). The first capping member 161 is connected to the suction pump 163 via the ink flow channel 162, and by opening the valve 164 provided in the ink flow channel 162, the pressure (P1) of the space defined by the first capping member 161 and the nozzle surface 50A is adjusted to be lower than the pressure (P2) of the space defined by the second capping member 165 and the nozzle surface 50A. Consequently, the relationship of the pressures is as follows: $P1<P2<P0$.

Figure 8:
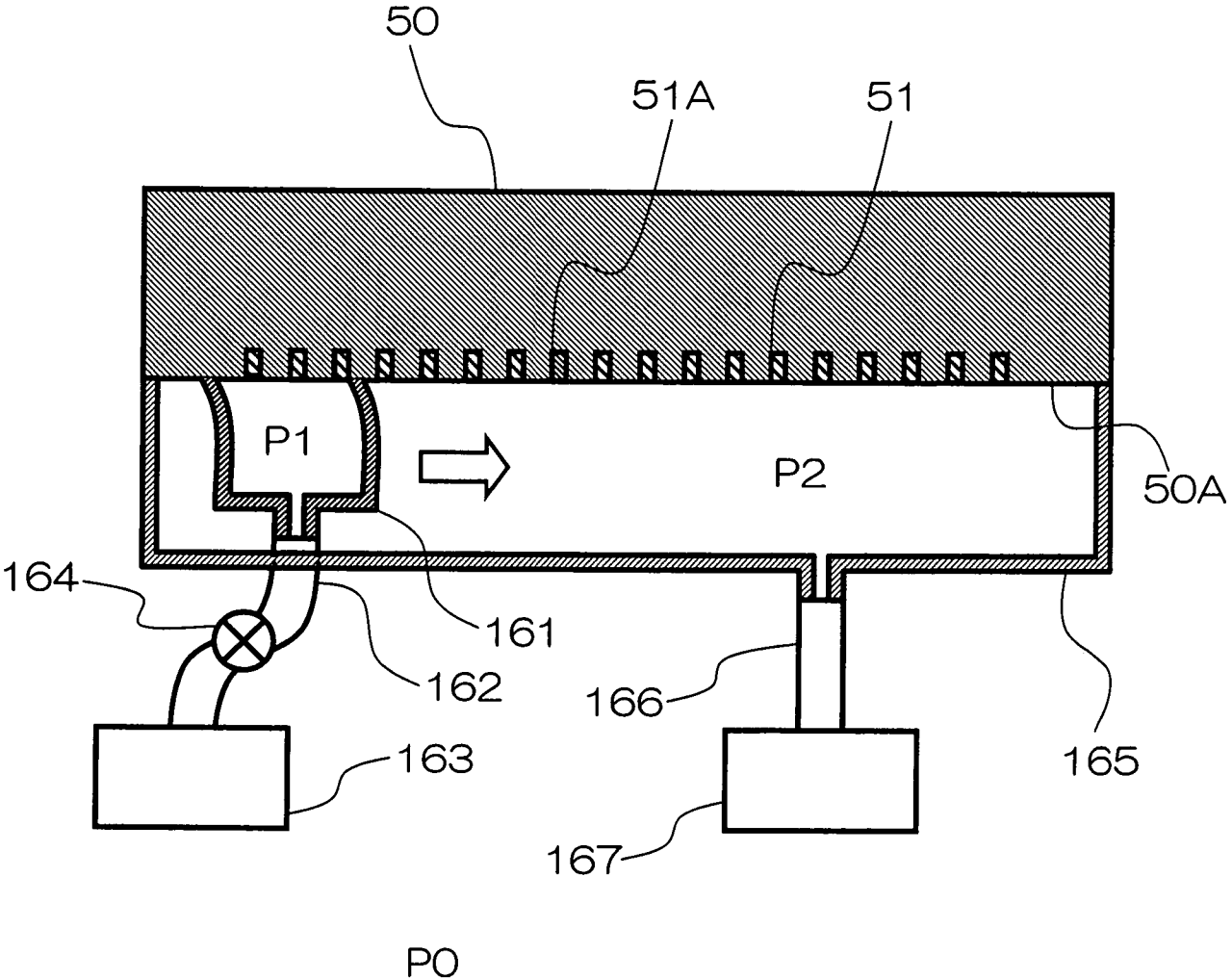
FIG. 8 is a diagram of an ejection restoration apparatus for a liquid ejection head according to a third embodiment of the present invention.

The first capping member 161 is moved in the direction of the arrow in FIG. 8, inside the second capping member 165; thereby, the maintenance of the nozzles 51 of the liquid ejection head 50 is carried out.

In the liquid ejection head 50, when the nozzles 51 located in the region covered with the first capping member 161 are suctioned, the ink in the nozzles 51 located in this region is suctioned. If the same common flow channel (not illustrated), and the like, are used for supplying ink to all nozzles 51, this suctioning force also acts on other nozzles 51 (non-suctioned nozzles) which are not suctioned directly, via the common flow channel; in other words, a force acts in the ink in the non-suctioned nozzles so as to cause the ink to be drawn back toward the common flow channel, depending on this suctioning force. In some cases, this may cause breakdown of the meniscus in other nozzles 51 (non-suctioned nozzles), which are not being suctioned, and may lead to introduction of air or foreign matter into these nozzles.

However, in the present embodiment, since the second capping member 165 is provided and the pressure (P2) of the space covered by the second capping member 165 is in the range between P1 and P0 (i.e., $P1<P2<P0$), then even if the pressure (P1) of the space defined by the first capping member 161 and the nozzle surface 50A becomes a negative pressure, it is still possible to prevent breakdown of the meniscus and introduction of air or foreign matter, in other nozzles 51 which are not covered by the first capping member 161 and which are not being suctioned.

Fourth Embodiment

Next, an ejection restoration apparatus for a liquid ejection head according to a fourth embodiment of the present invention is described below with reference to FIG. 9. In the fourth embodiment, a second capping member 165 is provided on the front side of a first capping member 161 in terms of the direction of movement of the first capping member 161.

More specifically, the second capping member 165 which covers a portion of the nozzle surface 50A of the liquid ejection head 50 is provided on the front side, in terms of the movement direction of the first capping member 161 which is capable of performing a movement for suctioning and wiping of the nozzles 51 of the nozzle surface 50A. The first capping member 161 and the second capping member 165 make contact with each other at a boundary between these capping members 161 and 165, and are united. The second capping member 165 is connected to a suction pump 167 via an ink flow channel 166, and the pressure (P2) in the space defined by the second capping member 165 and the nozzle surface 50A of the liquid ejection head 50 is set to a negative pressure compared to the atmospheric pressure (P0). The first capping member 161 is connected via the ink flow channel 162 to the suction pump 163, and by opening the valve 164 provided in the ink flow channel 162, the pressure (P1) of the space defined by the first capping member 161 and the nozzle surface 50A is adjusted to be lower than the pressure (P2) of the space defined by the second capping member 165 and the nozzle surface 50A. Consequently, the following relationship of the pressures is satisfied: P1<P2<P0.

Figure 9:
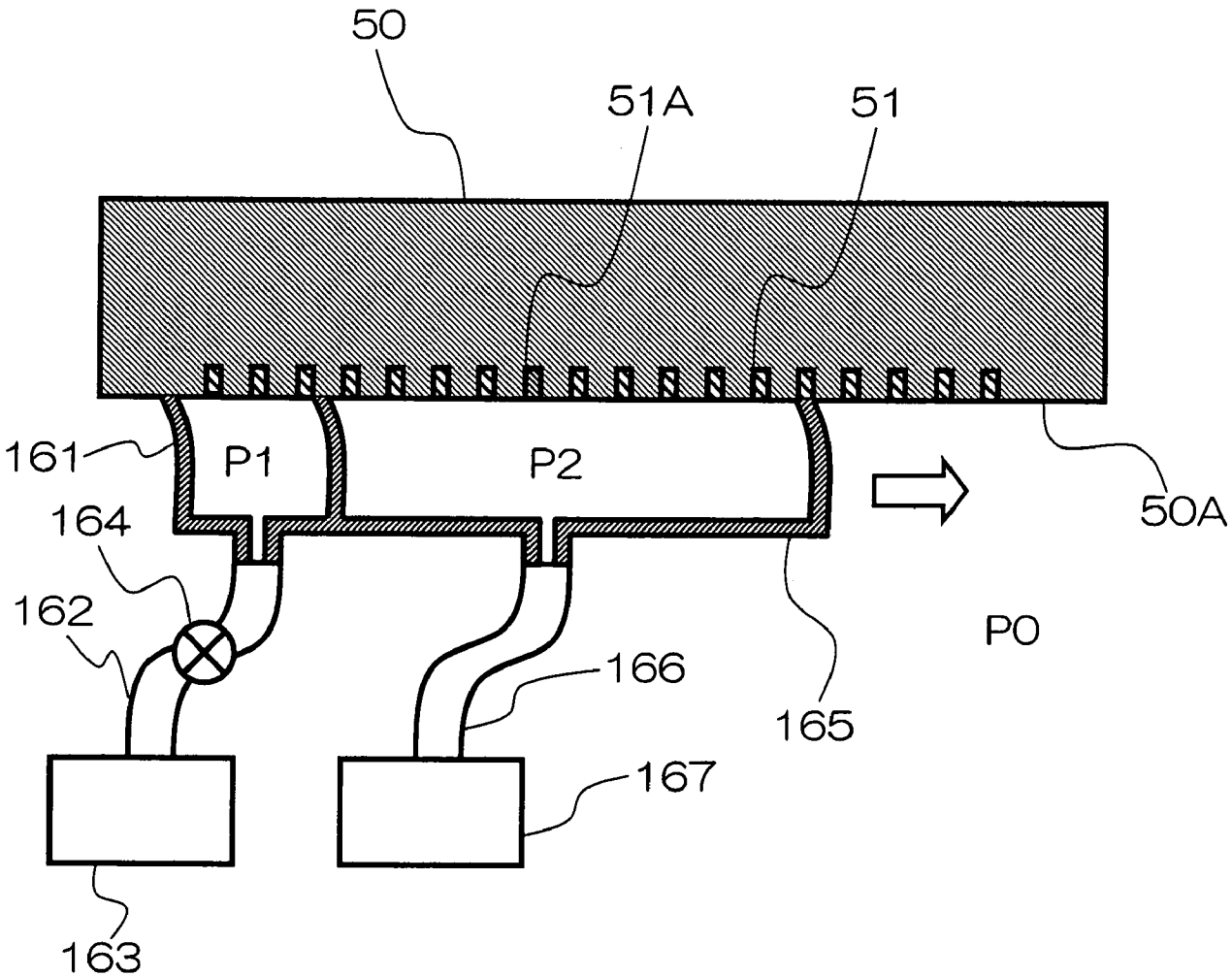
FIG. 9 is a diagram of an ejection restoration apparatus for a liquid ejection head according to a fourth embodiment of the present invention.

The first capping member 161 is moved in the direction of the arrow in FIG. 9, following the second capping member 165; thereby, the maintenance of the nozzles 51 of the liquid ejection head 50 is carried out.

In the liquid ejection head 50, when the nozzles 51 located in the region covered by the first capping member 161 are suctioned, the ink in the nozzles 51 located in that region is suctioned. If the same common flow channel (not illustrated), and the like, are used for supplying ink to all nozzles 51, this suctioning force also acts on other nozzles 51 (non-suctioned nozzles) which are not suctioned directly, via the common flow channel; in other words, a force acts in the ink in the non-suctioned nozzles so as to cause the ink to be drawn back toward the common flow channel, depending on this suctioning force. In some cases, this may cause breakdown of the meniscus in other nozzles 51 which are not being suctioned, and may lead to introduction of air or foreign matter into these nozzles.

However, in the present embodiment, since the second capping member 165 is provided and the pressure (P2) of the space covered by the second capping member 165 is in the range between P1 and P0 (i.e., P1<P2<P0), then even if the pressure (P1) of the space defined by the first capping member 161 and the nozzle surface 50A becomes a negative pressure, it is still possible to prevent breakdown of the meniscus and introduction of air or foreign matter in other nozzles 51 which are not covered by the first capping member 161 and which are not being suctioned. In the present embodiment, the second capping member 165 is disposed on the front side of the first capping member 161 in terms of the movement direction of the first capping member 161, for the following reason. Once nozzles 51 have undergone the maintenance by the first capping member 161 and consequently have a stable meniscus surface, the restored nozzles 51 that have undergone the maintenance are not liable to be affected by other nozzles 51 being suctioned by the first capping member 161. Accordingly, the second capping member 165 (or an equivalent member) is not required on the rear side of the first capping member 161. On the other hand, on the front side of the capping member 161 in terms of the movement direction of the capping member 161, since the nozzles 51 have not yet undergone the maintenance operation, then the meniscus surfaces in these nozzles 51 are not stabilized, but rather are in a state where breakdown of the meniscus, or infiltration of air or foreign matter, is liable to occur due to the effects of the nozzles 51 being suctioned by the first capping member 161. Therefore, it is necessary to set the nozzles 51 in this region to a certain level of negative pressure. The second capping member 165 is not required to cover the whole of the nozzle surface 50A and it may cover only a prescribed region of the nozzle surface 50A. This is because the more distant the nozzles 51 are from the first capping member covering the suctioned nozzles 51, the less effect these nozzles receives via the common flow channel (not illustrated).

Fifth Embodiment

Next, an ejection restoration apparatus for a liquid ejection head according to a fifth embodiment of the present invention is described below with reference to FIG. 10. In the fifth embodiment, a liquid ejection head having a rear surface flow channel structure in which the ink supplied from the ink supply port flows inside the common flow channel in the same direction as the direction of movement of the capping member 61.

Here, the fifth embodiment is described below in more specific terms. The ejection restoration apparatus of the liquid ejection head according to the present embodiment includes the capping member 61, the ink flow channel 62, the suction pump 63, and the valve 64. The ejection restoration apparatus of the liquid ejection head used in the present embodiment serves to carry out maintenance of the liquid ejection head having the rear surface flow channel structure shown in FIG. 10. More specifically, the liquid ejection head 50 has a common flow channel 55, and the common flow channel 55 is provided with an ink supply port 68 which supplies ink to the common flow channel 55. The ink then flows from the common flow channel 55 to the pressure chambers 52 via the supply ports 54 in order to supply the ink to the nozzles 51, and when printing is performed, the ink is ejected from the nozzles 51 by driving the piezoelectric elements (not illustrated). During suctioning in a maintenance operation, the ink is also expelled from nozzles 51. The ink ejected or expelled from nozzles 51 creates a shortage of ink inside pressure chambers 52, and new ink is accordingly supplied from the ink supply port 68, via the common flow channel 55 and supply ports 54. The ink supplied from the ink supply port 68 flows inside the common flow channel 55 in the direction of the arrow in FIG. 10. In carrying out the maintenance, in cases where the ink is suctioned from nozzles 51 that are located in the vicinity of the ink supply port 68, since the fluid resistance is low in this region, then there is little effect on other nozzles 51 which are not being suctioned. On the other hand, in cases where the ink is suctioned from nozzles 51 that are distant from the ink supply port 68, since the fluid resistance is high, then there is a large effect on other nozzles 51 which are not being suctioned and which are located nearer to the ink supply port 68, and consequently the meniscus surface may be withdrawn and infiltration of air or foreign matter may occur in these nozzles 51.

Therefore, the maintenance is carried out initially for nozzles 51 in the nozzle surface 50A that are located in the vicinity of the ink supply port 68, in other words, the capping member 61 is moved following the direction of the flow of the ink supplied from the ink supply port 68. Thereby, the meniscus surface is not withdrawn and air or foreign matter does not enter these nozzles 51 since the nozzles 51 which have undergone maintenance have a stable meniscus. Moreover, since the nozzles 51 which have not yet undergone maintenance (nozzles that are distant from the ink supply port 68) have a higher fluid resistance than the nozzles 51 which have undergone suctioning, then there is little effect on these nozzles 51, and the meniscus surface is not withdrawn and air or foreign matter does not enter these nozzles 51.

Figure 10:
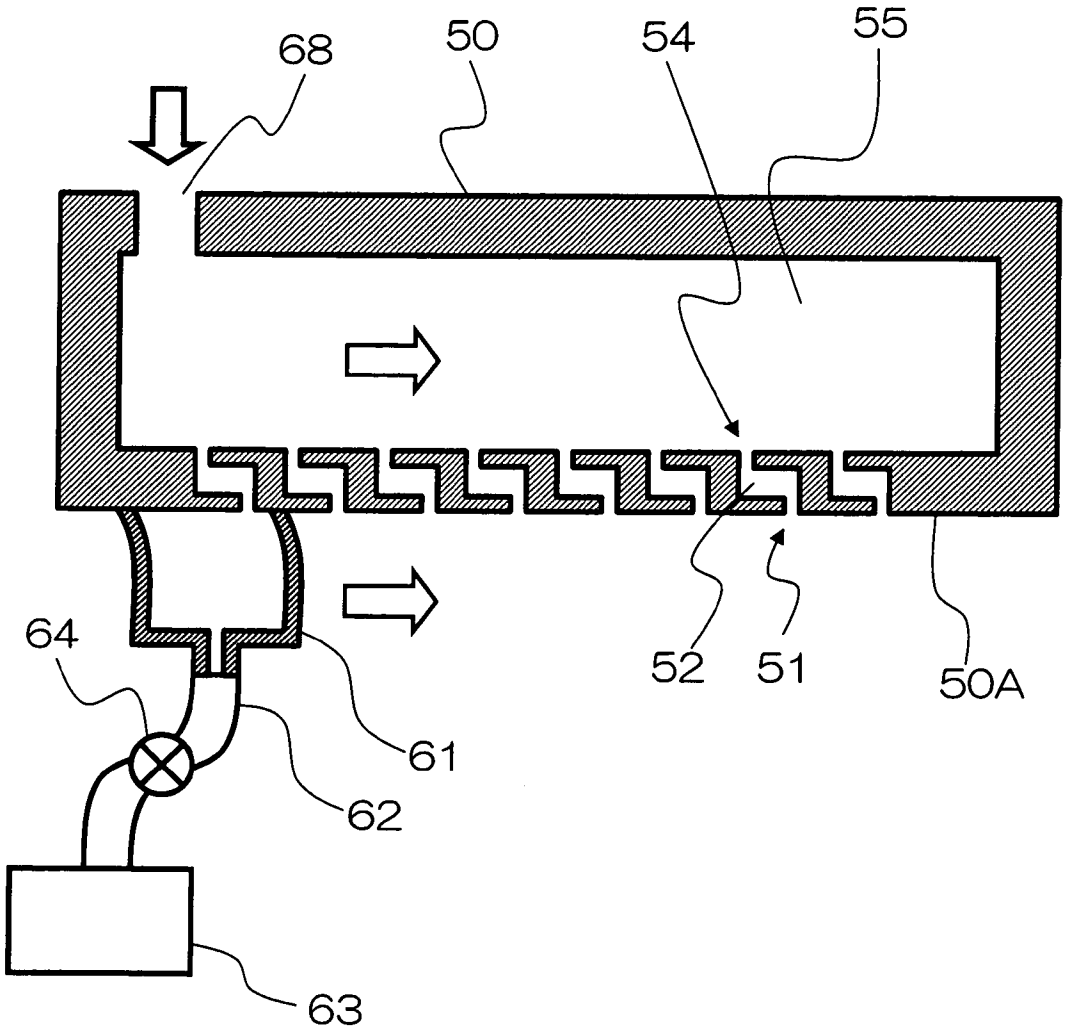
FIG. 10 is a diagram of an ejection restoration apparatus for a liquid ejection head according to a fifth embodiment of the present invention.

More specifically, while maintenance is carried out, the capping member 61 is moved in the same direction as the direction of the flow of ink inside the common flow channel 55 shown in FIG. 10 (namely, the direction indicated by the arrow in FIG. 10).

Liquid ejection heads and image forming apparatuses according to embodiments of the present invention have been described in detail above. However, it should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An ejection restoration apparatus for a liquid ejection head having a plurality of nozzles which are disposed in a planar nozzle surface and from which liquid is ejected, the ejection restoration apparatus comprising:

a first suction cap which covers a partial region of the planar nozzle surface and which has a contact portion being constituted by an elastic body and making contact with the planar nozzle surface, the partial region being smaller than area of the planar nozzle surface in which the nozzles are disposed and being larger than cross-sectional area of one of the nozzles;

a suction cap movement device which moves the first suction cap in parallel with the planar nozzle surface while causing the contact portion of the first suction cap to make contact with the planar nozzle surface;

a nozzle abnormality detection device which detects an abnormal nozzle suffering an abnormality, in the nozzles; and a suction control device which causes the first suction cap to suction the liquid in the abnormal nozzle detected by the nozzle abnormality detection device, wherein the first suction cap is moved on the planar nozzle surface in a state where a space defined by the first suction cap and the planar nozzle surface is set to a pressure lower than an atmospheric pressure, so that the first suction cap fulfills both a wiping function and a suctioning function.

2. The ejection restoration apparatus for a liquid ejection head as defined in claim 1, wherein:

the contact portion includes a front portion situated on a front side and a rear portion situated on a rear side in terms of a movement direction of the first suction cap; and the rear portion has a rigidity lower than the front portion.

3. The ejection restoration apparatus for a liquid ejection head as defined in claim 1, further comprising a second suction cap which is provided on an outer side of the first suction cap so as to cover a whole of the first suction cap, wherein a following inequality is satisfied:

$$P1 \geq P2 < P0,$$

where P1 is a pressure of the space defined by the first suction cap and the planar nozzle surface, P2 is a pressure of a space defined by the second suction cap and the planar nozzle surface, and P0 is the atmospheric pressure.

4. The ejection restoration apparatus for a liquid ejection head as defined in claim 1, further comprising a second suction cap provided on a front side of the first suction cap in terms of a movement direction of the first suction cap, wherein a following inequality is satisfied:

$$P1 \geq P2 < P0,$$

where P1 is a pressure of the space defined by the first suction cap and the planar nozzle surface, P2 is a pressure of a space defined by the second suction cap and the planar nozzle surface, and P0 is the atmospheric pressure.

5. The ejection restoration apparatus for a liquid ejection head as defined in claim 1, wherein the suction cap movement device moves the first suction cap in such a manner that, in maintenance of the liquid ejection head, a movement direction of the first suction cap corresponds to a direction of flow of the liquid in a common flow channel which is supplied to the common flow channel via a liquid supply port, the common flow channel being provided on a side of the nozzles reverse to a liquid ejection side of the nozzles and supplying the nozzles with the liquid.

6. An image forming apparatus comprising the ejection restoration apparatus for a liquid ejection head according to claim 1.

* * * * *